US007854255B2

(12) United States Patent
Nakamura

(10) Patent No.: US 7,854,255 B2
(45) Date of Patent: Dec. 21, 2010

(54) HEAT EXCHANGER

(75) Inventor: Yoichi Nakamura, Nagoya (JP)

(73) Assignee: T. Rad Co., Ltd., Tokyo (JP)

( * ) Notice: Subject to any disclaimer, the term of this patent is extended or adjusted under 35 U.S.C. 154(b) by 935 days.

(21) Appl. No.: 11/664,081

(22) PCT Filed: Sep. 27, 2005

(86) PCT No.: PCT/JP2005/018257

§ 371 (c)(1),
(2), (4) Date: Mar. 27, 2007

(87) PCT Pub. No.: WO2006/035985

PCT Pub. Date: Apr. 6, 2006

(65) Prior Publication Data

US 2009/0194265 A1 Aug. 6, 2009

(30) Foreign Application Priority Data

Sep. 28, 2004 (JP) ..... 2004-281862

(51) Int. Cl.
*F28F 3/00* (2006.01)
*F28D 1/00* (2006.01)

(52) U.S. Cl. ..... 165/166; 165/158; 165/149

(58) Field of Classification Search ..... 165/4, 165/9.4, 173, 185, 164, 165, 166, 157, 158, 165/159, 149
See application file for complete search history.

(56) References Cited

U.S. PATENT DOCUMENTS 2,019,351 A 10/1935 Lanthrop
2,803,440 A * 8/1957 Simpelaar ..... 165/179
3,508,606 A * 4/1970 Anderson et al. ..... 165/145

(Continued)

FOREIGN PATENT DOCUMENTS

EP 0 942 156 9/1999

(Continued)

*Primary Examiner*—Tho V Duong
(74) *Attorney, Agent, or Firm*—Jordan and Hamburg LLP

(57) ABSTRACT

In a heat exchanger in which the number of parts is small, assembling is easy, bonded portions between each part are fewer and reliability of brazing is improved, a core body is constituted by turning up and bending a strip-shaped metal plate in a fanfold manner, and first flow passages and second flow passages are formed alternately in the thickness direction. Both ends of each of the first flow passages are blocked by each comb tooth of a pair of comb-state members, and a fin is set within the second flow passages so as to constitute a core. And a cylindrical casing is fitted with the outer periphery of the core body, and the casing is constituted by a channel-state material covering three faces of the outer periphery of the core body and a lid material blocking an opening of the channel-state material. In the core body, a starting end and a terminating end of the turning-up/bending of the strip-shaped metal plate are both located on the turned-up end edge on one side, the starting end the terminating end form a fitting edge portion turned-up with the section in the U-shape conforming to the plate thickness of the channel-state material, and the end edge of the opening of the channel-state material is fitted with the fitting edge portion so as to braze/fix the both.

1 Claim, 10 Drawing Sheets

U.S. PATENT DOCUMENTS

| | | | | | |
|---|---|---|---|---|---|
| 3,719,227 | A | * | 3/1973 | Jenssen | 165/166 |
| 3,734,177 | A | | 5/1973 | Bellovary et al. | |
| 3,829,945 | A | * | 8/1974 | Kanzler et al. | 29/890.03 |
| 3,842,820 | A | * | 10/1974 | Michels et al. | 126/110 R |
| 4,254,827 | A | * | 3/1981 | Forster et al. | 165/166 |
| 4,473,111 | A | | 9/1984 | Steeb | |
| 5,111,671 | A | | 5/1992 | Kadle | |
| 5,282,507 | A | | 2/1994 | Tongu et al. | |
| 5,470,531 | A | * | 11/1995 | Sjogren et al. | 422/46 |
| 5,720,341 | A | | 2/1998 | Watanabe et al. | |
| 6,016,865 | A | | 1/2000 | Blomgren | |
| 6,059,023 | A | | 5/2000 | Kurematsu | |
| 6,102,111 | A | | 8/2000 | Kamio et al. | |
| 6,141,961 | A | | 11/2000 | Rinckel | |
| 6,269,870 | B1 | | 8/2001 | Banzhaf et al. | |
| 6,293,337 | B1 | | 9/2001 | Strahle et al. | |
| 6,321,835 | B1 | | 11/2001 | Damsohn et al. | |
| 6,408,941 | B1 | | 6/2002 | Zuo | |
| 6,807,955 | B2 | | 10/2004 | Leedham et al. | |
| 6,898,930 | B2 | | 5/2005 | Nakatani et al. | |
| 6,976,480 | B2 | | 12/2005 | Miyoshi et al. | |
| 6,997,250 | B2 | | 2/2006 | Dilley et al. | |
| 7,032,577 | B2 | | 4/2006 | Rosin et al. | |
| 7,077,190 | B2 | | 7/2006 | Hayashi et al. | |
| 7,159,649 | B2 | | 1/2007 | Thyrum et al. | |
| 7,168,419 | B2 | | 1/2007 | Rosin et al. | |
| 7,204,302 | B2 | | 4/2007 | Shibagaki et al. | |
| 7,284,599 | B2 | | 10/2007 | Karoliussen | |
| 7,287,579 | B2 | | 10/2007 | Dilley et al. | |
| 7,311,090 | B2 | | 12/2007 | Lyons | |
| 7,438,062 | B2 | | 10/2008 | Okawa et al. | |
| 2005/0121173 | A1 | | 6/2005 | Inagaki et al. | |
| 2006/0048926 | A1 | | 3/2006 | Richter | |
| 2007/0289318 | A1 | | 12/2007 | Nakamura | |
| 2008/0087409 | A1 | | 4/2008 | Nakamura | |
| 2008/0135221 | A1 | | 6/2008 | Nakamura | |

FOREIGN PATENT DOCUMENTS

| | | |
|---|---|---|
| EP | 1 164 280 | 12/2001 |
| EP | 1363012 | 11/2003 |
| EP | 1555421 | 7/2005 |
| EP | 1630403 | 3/2006 |
| EP | 1746263 | 1/2007 |
| JP | 60-147097 | 8/1985 |
| JP | 60-150468 | 8/1985 |
| JP | 63-088212 | 4/1988 |
| JP | 5-018634 | 1/1993 |
| JP | 10-122768 | 5/1998 |
| JP | 2001-141388 | 5/2001 |
| JP | 2002-318095 | 10/2002 |
| JP | 2004-257366 | 9/2004 |
| JP | 2004-278351 | 10/2004 |
| WO | WO-02/10574 | 2/2002 |
| WO | WO-2004/065876 | 8/2004 |

* cited by examiner

HEAT EXCHANGER

BACKGROUND OF THE INVENTION

The present invention relates to a heat exchanger in a simple structure which can be applied to a heat exchanger (EGR cooler) used in an exhaust gas recirculation apparatus in an automobile and other heat exchangers, in which a core body formed by turning up and bending a strip-shaped metal plate in a fanfold manner and having flat first flow passages and second flow passages alternately in the thickness direction of the metal plate, each of the first flow passages of the core body being blocked by each comb tooth of a pair of comb-state members at both end positions.

A conventional EGR cooler is made of an assembly of a large number of flat tubes or a large number of plates, a large number of fins, a casing and a header, in which cooling water is made to communicate through the casing side and an exhaust gas is made to communicate inside each of the flat tubes or the like as proposed in the invention described in Japanese Patent Application Laid-Open No. 5-18634.

Another heat exchanger in which a core of the heat exchanger is formed by a strip-shaped metal plate bent in a fanfold manner and a pair of comb-state members, the outer periphery being fitted with a cylindrical casing, and tanks are provided at both ends in the longitudinal direction as proposed in the invention described in WO 2004/065876 A1.

In the former heat exchanger such as the EGR cooler, the number of parts is large, which makes assembling cumbersome and increases the number of brazing portions on the parts, and there is a problem that a leakage tends to occur at the brazing portion.

In the core of the latter heat exchanger, comb teeth of the comb-state member are arranged at every other portion of the large number of flat groove portions in a core body formed in the fanfold state, and the groove bottom and the tip end of the comb tooth are bonded. And the casing is fitted with the outer periphery of the core. The casing is formed in the cylindrical state with a channel-state material covering three faces of the outer periphery of the core body and a lid member blocking the opening of the channel-state material, and the both ends are connected to the header. In this type of heat exchanger, there is a problem that a crack tends to occur at a joint between the casing and the core body, from which leakage of a fluid easily occurs. Along with that, leakage tends to occur at the brazing portion between the tooth base of the comb-teeth and the side face of the core body.

The present invention has an object to provide a reliable heat exchanger in which the number of parts is small, assembling is easy, strength at the brazing portion is high, and leakage is hard to occur.

SUMMARY OF THE INVENTION

The present invention in accordance with a first aspect thereof is a heat exchanger comprising a core body (5) in which a strip-shaped metal plate is turned up and bent in a fanfold manner with turned-up end edges (1), (2) alternately formed at one end and the other end of a rectangular flat face portion (1*a*) and flat first flow passages (3) and second flow passages (4) are provided alternately in the thickness direction of the metal plate, each of the first flow passages (3) of the core body (5) being blocked by each comb tooth (6*b*) of a pair of comb-state members (6) at both end positions of the turned-up end edge (1), and a fin (7) being set within the second flow passages (4) so as to constitute a core (8), the outer periphery of the core body (5) being fitted with a cylindrical casing (9) so as to block the adjacent turned-up end edges (1), (2), a first fluid (10) being guided to each of the first flow passages (3) by a pair of ports (11) on the outer face of the casing (9), while a second fluid (12) being guided from one of cylindrical openings (13) to the other opening (13) through each of the second flow passages (4), wherein the casing (9) comprises a channel-state material (9*a*) covering three faces of the outer periphery of the core body (5) and a lid material (9*b*) blocking the opening of the channel-state material (9*a*);

in the core body (5), a starting end and a terminating end of the turning-up of the strip-shaped metal plate are both located at the turned-up end edge on one side;

a fitting edge portion (15) with a section turned up in the U-shape conforming to the plate thickness of the channel-state material (9*a*) is provided at the starting end and the terminating end; and the end edge of the opening of the channel-state material (9*a*) is fitted with the fitting edge portion (15) and the both are brazed and fixed.

The present invention in accordance with a second aspect of the invention is a heat exchanger in accordance with a first aspect of the invention, wherein an end edge of the lid material (9*b*) is turned up and the turned-up portion is brazed to be fitted with the outer periphery of the fitting edge portion (15) in the contact state.

The present invention in accordance with a third aspect of the invention is a heat exchanger in accordance with the first or second aspect of the invention, wherein the section of the opening of the fitting edge portion (15) and the channel-state material (9*a*) is wound/tightened and bent in the L-shape.

The present invention in accordance with a fourth aspect of the invention is a heat exchanger in accordance with the second or third aspect of the invention, wherein the plate thickness of the channel-state material 9*a* and the lid material 9*b* is formed larger than that of the core body 5.

The present invention in accordance with a fifth aspect thereof is a heat exchanger in accordance with any of the first to fourth aspects thereof, wherein a tooth base (6*c*) and the comb tooth (6*b*) of the comb-state member (6) are made to cross perpendicularly to each other, a root (14) of the comb tooth (6*b*) is bent in the L-shape, and each connection portion between the comb-state member (6) and the core body (5) as well as the lid material (9*b*) is brazed/fixed integrally in the state where the tooth base (6*c*) is held between a side face of the core body (5) and the lid material (9*b*).

The present invention in accordance with a sixth aspect thereof is a heat exchanger in accordance with any of the first to fifth aspects thereof, wherein a high heat-resistant/corrosion-resistant material is used for the channel-state material (9*a*) constituting the casing (9), while the lid material (9*b*) is formed by a material with lower heat-resistance/corrosion-resistance than that of the channel-state material (9*a*);

both ends of the casing (9) in the longitudinal direction constitute a pair of header portions (31) projecting outward from the both ends of the core body (5), and both opening ends of the casing (9) are blocked by header end lids (16), (17) made of a high heat-resistant/corrosion-resistant material; and the header end lids (16), (17) have extension portions (16*a*), (17*a*) covering the inner surface of the lid material (9*b*) of the header portion (31).

The heat exchanger of the present invention is constructed as above and has the following effects.

In the present invention, the casing 9 is formed by the channel-state material 9*a* and the lid material 9*b*, the fitting edge portion 15 with the section in the U-shape is formed at both edge portions of the core body 5 bent in the fanfold manner, and a tip end portion of the channel-state material 9*a* is fitted with the fitting edge portion 15 and the both are brazed/fixed. Therefore, brazing strength at the joint between the core body 5 and the casing, where a crack is particularly easy to occur, is increased, and reliability of brazing can be improved.

In the above construction, in the state where the end edge of the lid material 9*b* is bent and the bent portion is fitted with the outer periphery of the fitting edge portion 15 in contact and the both are brazed together, a brazing area between the lid material 9*b* and the core body 5 is sufficiently ensured, a gap between the both is eliminated and reliability of brazing can be improved.

In the above construction, in the state where the section at the end of the opening of the fitting edge portion 15 and the channel-state material 9*a* is wound/tightened and bent in the L-shape, reliability of brazing can be further improved.

In the above construction, in the state where the plate thickness of the channel-state material 9*a* and the lid material 9*b* is made larger than that of the core body 5, manufacture of the core body 5 bent in the complicated state is facilitated, accuracy of the U-shaped sectional portion can be increased, and brazing accuracy of the core body 5 and the channel-state material 9*a* as well as the lid material 9*b* can be improved.

In the above construction, in the state where the tooth base 6*c* and the comb tooth 6*b* of the comb-state member 6 are made to cross perpendicularly to each other, the root 14 of the comb tooth 6*b* is bent in the L-shape and each connection portion of the comb-state member 6 and the core body 5 as well as the lid material 9*b* is integrally brazed/fixed with the tooth base 6*c* held between the side face of the core body 5 and the lid material 9*b*, a brazing area between the tooth base 6*c* and the lid material 9*b* as well as the core body 5 can be ensured to be large, a gap can be eliminated, and leakage can be prevented.

In the above construction, a material with higher heat-resistance/corrosion-resistance than that of the lid material 9*b* can be used for the channel-state material 9*a*, a pair of header portions 31 may be provided at both ends of the casing 9 in the longitudinal direction comprised by them, the openings of the header portions 31 may be blocked by a pair of high heat-resistant/corrosion-resistant header end lids 16, 17, and the inner surface portion of the header portion 31 of the lid material 9*b* is covered by the extension portions 16*a*, 17*a* extended from the header end lids 16, 17. In this case, the heat exchanger can be provided at a lower cost, because a portion with lower heat-resistance/corrosion-resistance of the header portion 31 can be compensated only by the small extension portions 16*a*, 17*a*, and a material of the lid material 9*b* can be obtained inexpensively.

DETAILED DESCRIPTION OF THE INVENTION

Next, an embodiment of the present invention will be described based on the attached drawings.

Figure 1:
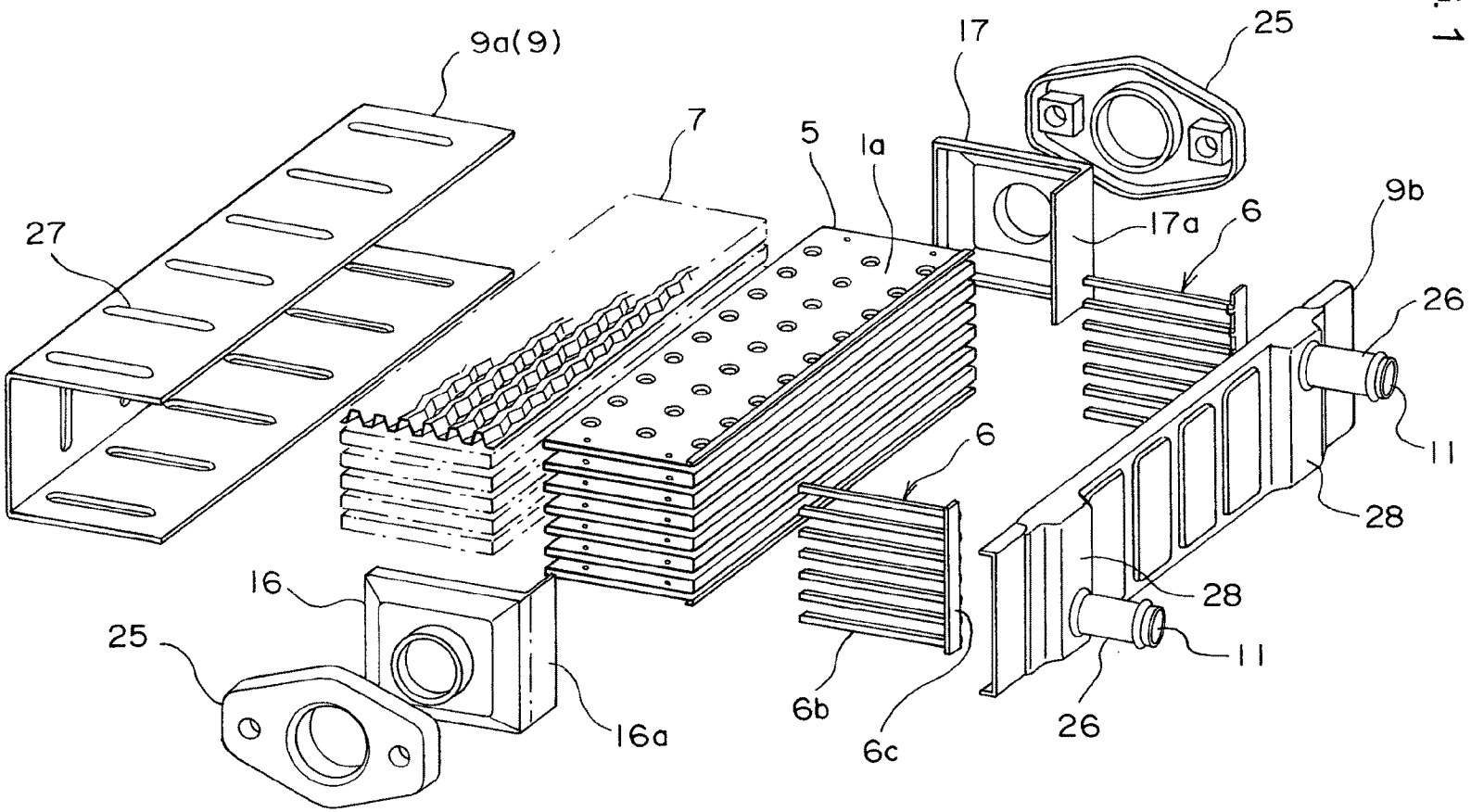
FIG. 1 is an exploded perspective view of a heat exchanger of the present invention.
Figure 2:
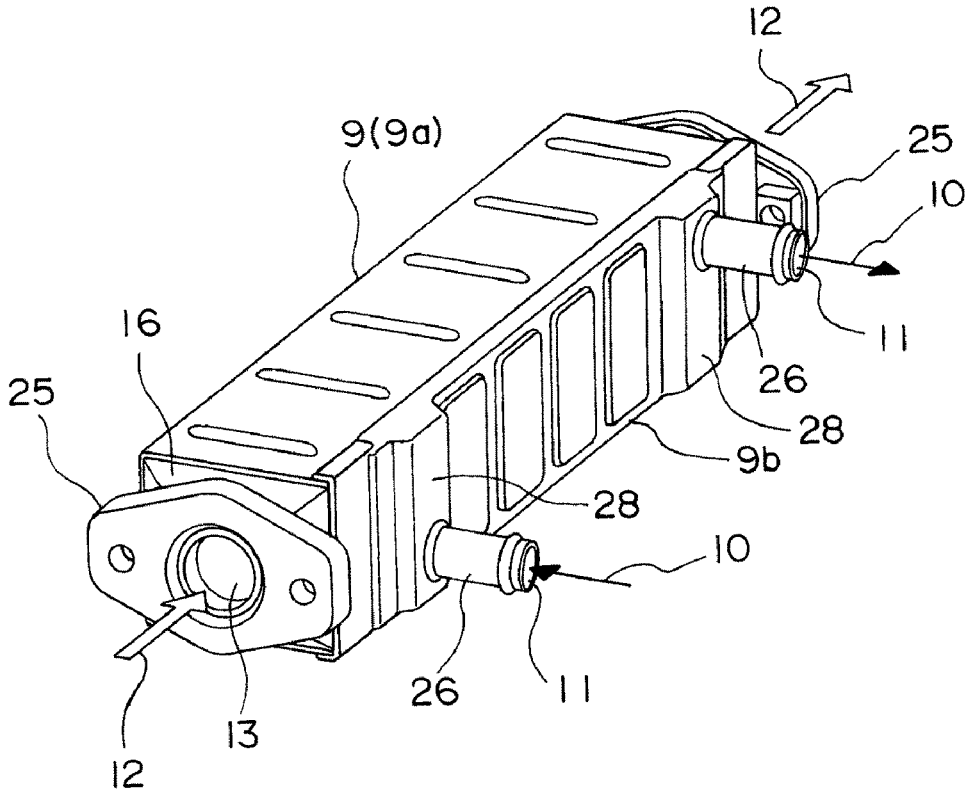
FIG. 2 is a perspective view illustrating an assembled state of the heat exchanger.
Figure 3:
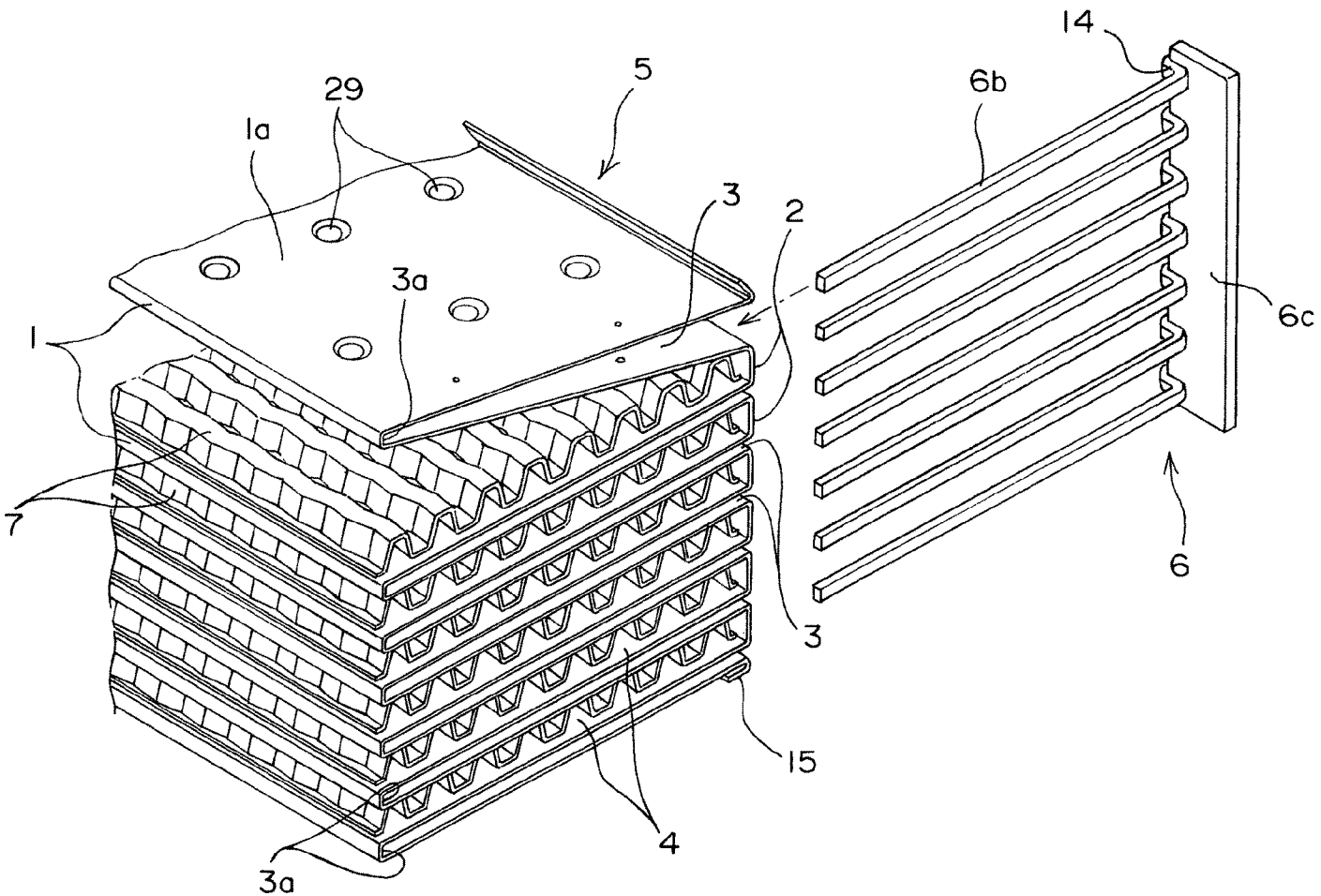
FIG. 3 is an explanatory view of an assembly of a core body 5 and a comb-state member 6 of the heat exchanger.
Figure 4:
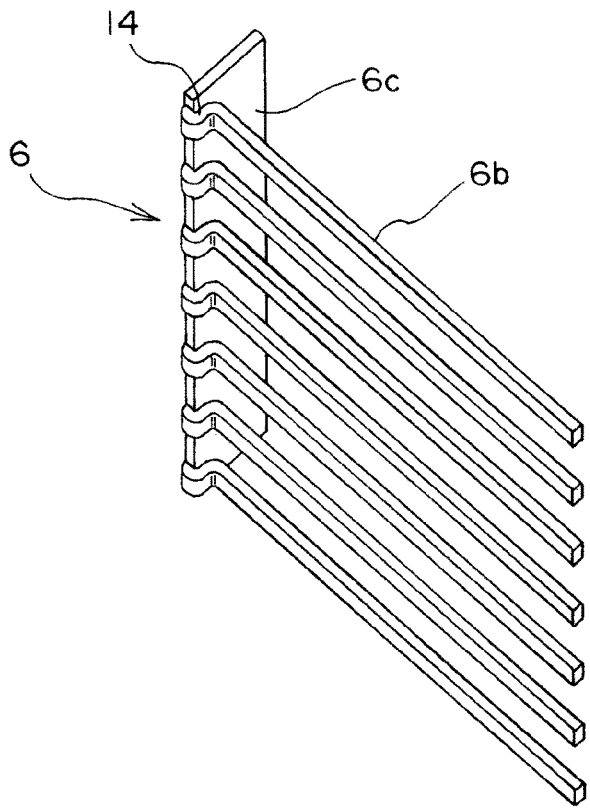
FIG. 4 is a perspective view of the comb-state member 6.
Figure 5:
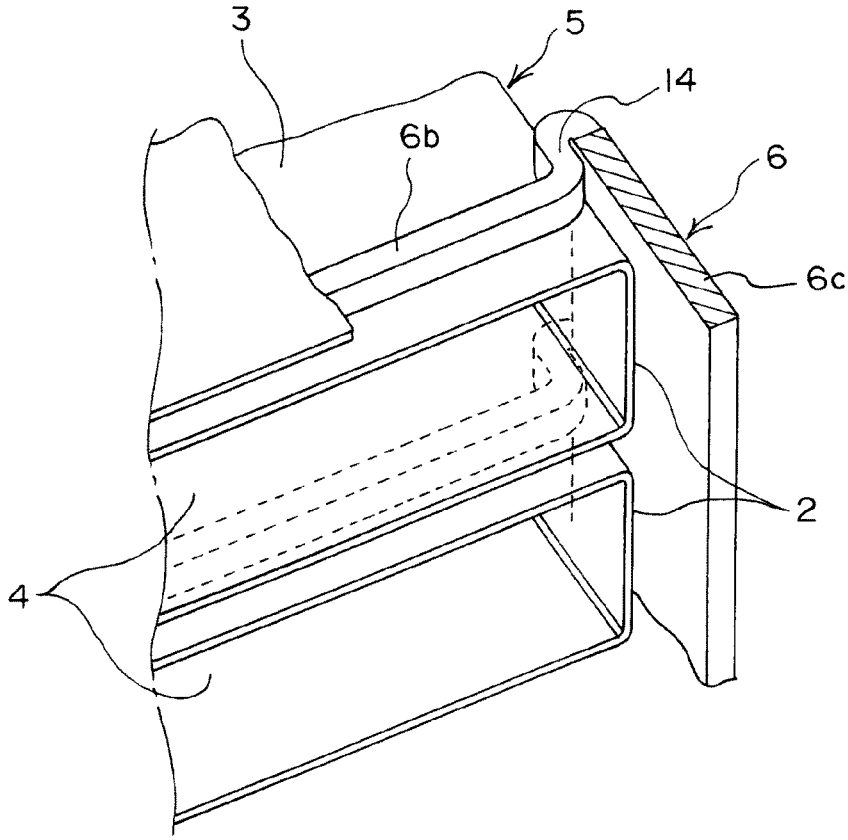
FIG. 5 is an enlarged perspective view of an essential part illustrating a state where the comb-state member 6 is inserted into the core body 5.
Figure 6:
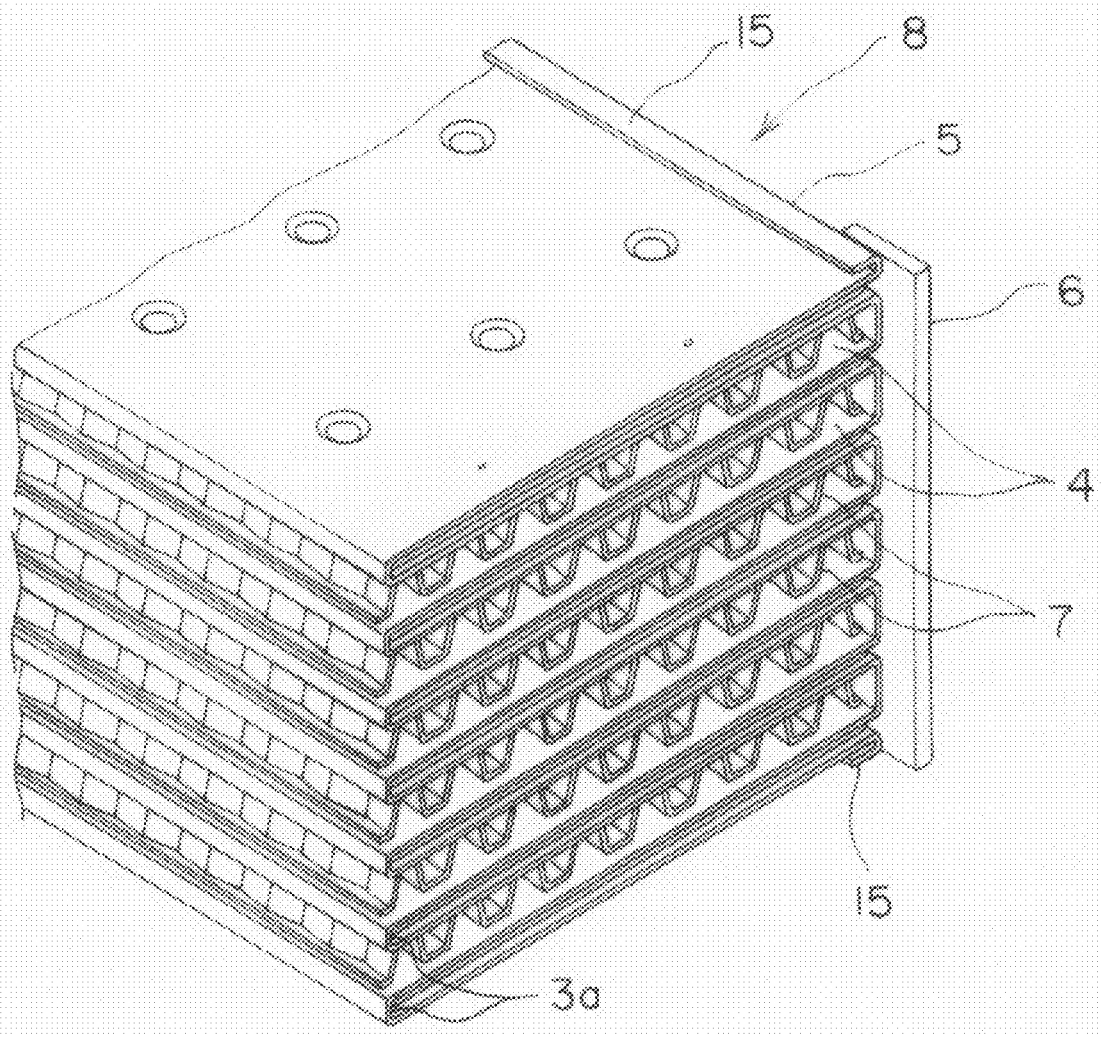
FIG. 6 is a perspective view illustrating an assembled state of the comb-state member 6 and the core body 5.

FIG. 1 is an exploded perspective view of a heat exchanger of the present invention, FIG. 2 shows its assembled state and FIG. 3 is an explanatory view of an assembly of a core body 5 and a comb-state member 6. Also, FIG. 4 is a perspective view of the comb-state member 6, FIG. 5 is a partially cut-away enlarged perspective view illustrating the assembled state, and FIG. 6 is a perspective view of the assembled state.

Figure 8:
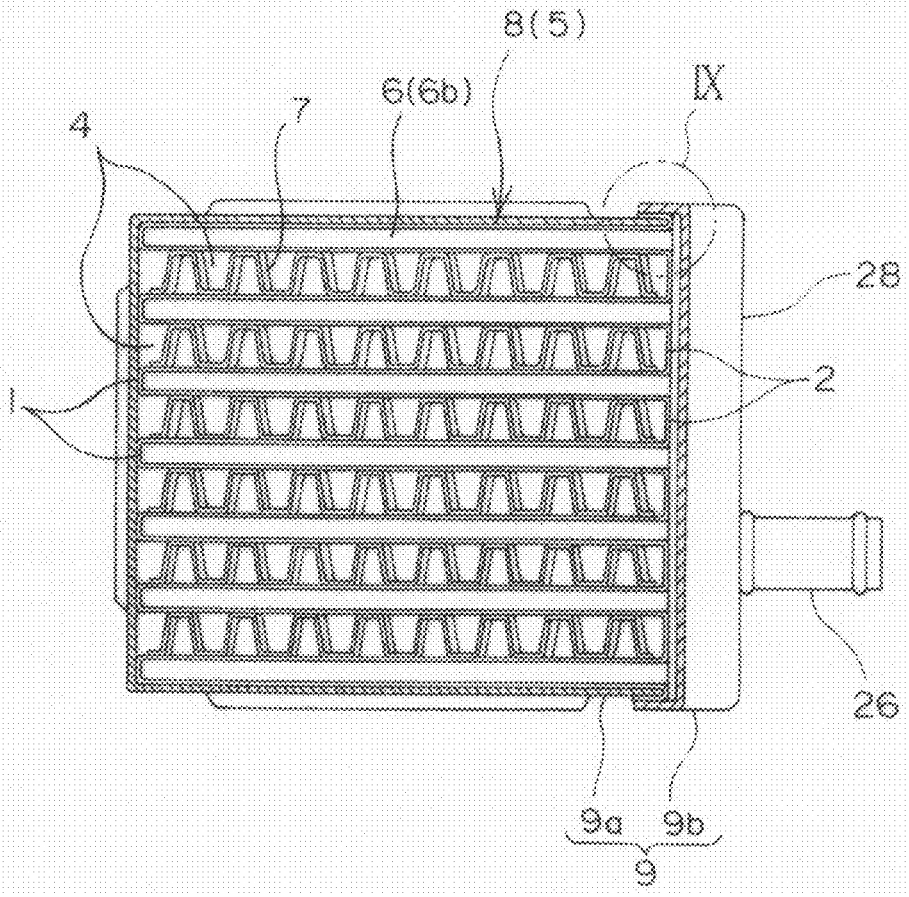
FIG. 8 is a cross sectional view of the heat exchanger of the present invention.
Figure 9:
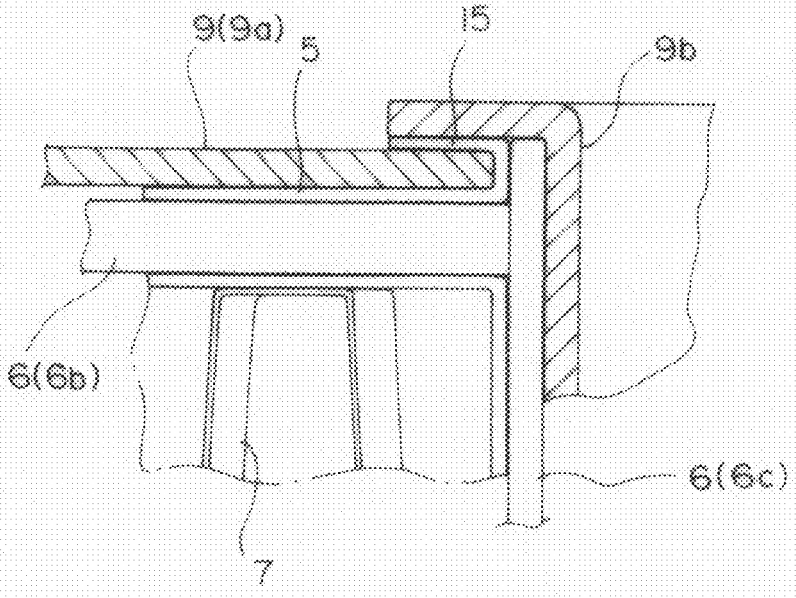
FIG. 9 is an enlarged view of IX part of FIG. 8.
Figure 10:
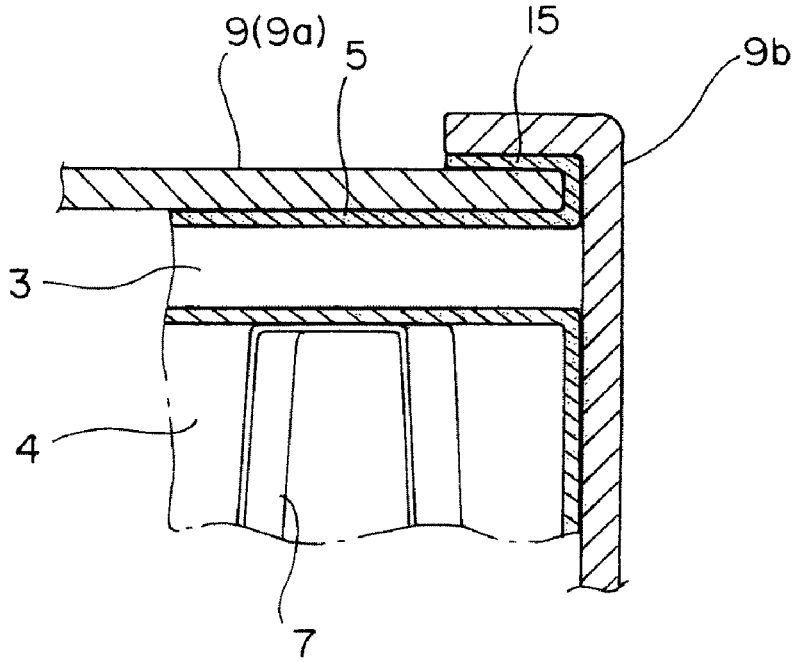
FIG. 10 is the same enlarged view of an intermediate portion of the core in the longitudinal direction.

Further, FIG. 8 is a cross sectional view of the heat exchanger, and FIG. 9 is an enlarged view of IX part of FIG. 8.

This heat exchanger has the core body 5, a large number of fins 7, a casing 9, a pair of headers 16, 17, and the pair of comb-state members 6.

The core body 5 is comprised by turning up and bending a strip-shaped metal plate in a fanfold manner as shown in FIG. 3 so that turned-up end edges 1, 2 are formed alternately at one end and the other end of a rectangular flat face portion 1*a*, and flat first flow passages 3 and second flow passages 4 are provided alternately in the thickness direction of the metal plate. In this example, a space of the first flow passage 3 is formed smaller than that of the second flow passage 4. It is needless to say that the spaces of the both can be the same or vice versa.

A large number of dimples 29 are formed on the first flow passage 3 side of the strip-shaped metal plate. In this example, the opposing dimples 29 are brought into contact with each other at their tip ends so as to hold the space of the first flow passage 3 constant. To each of the first flow passages 3, each of the comb-state members 6 is fitted at the both end positions of the turned-up end edges 1, and the fitted portions are integrally brazed/fixed. Also, instead of the dimples, an inner fin may be inserted into the first flow passage 3 and the inner face and both sides in the thickness direction of the inner fin may be brazed/fixed together.

In the comb-state member 6, a tooth base 6*c* is provided to be perpendicular to a comb tooth 6*b*, and a root 14 of the comb tooth 6*b* is bent in the L-shape along the comb base 6*c* (FIGS. 4, 5).

The comb-state member 6 constructed as above is, as shown in FIG. 5, has its tooth base 6*c* in contact with the end face of the turned-up end edge 2, and the root 14 is in contact with the corner part and further, it is in contact with a lid member 9*b* as shown in FIG. 9 so that a brazed area of each contact portion is large. By this, reliability of brazing is improved.

The root 14 and the tooth base 6*c* are in contact or fabricated with an extremely slight gap.

Next, the fins 7 are set between each of the second flow passages 4 as shown in FIG. 3. Though the first flow passage 3 at the uppermost position is shown in the lifted state in FIG. 3 so that the fin 7 is easy to be seen, the lower face side of the first flow passage 3 at the uppermost position is actually in contact with the fin 7 on the uppermost stage as shown in FIG. 6. This fin 7 is formed by bending a metal plate in the waveform in the cross-sectional direction and also in the longitudinal direction of its ridge line and trough portion so as to improve agitating effect of a fluid communicating through the second flow passage 4.

A core 8 in FIG. 6 is constituted by an assembly of the core body 5, the comb-state member 6, and the fin 7 as above. Instead of the above fin 7, a slit fin, an offset fin or a louver fin, not shown, may be inserted into the second flow passage 4.

Next, the casing 9 fitted over the outer periphery of this core 8 is formed in the cylindrical shape with a rectangular section longer than the length of the core 8 and has a pair of header portions 31 (See FIGS. 12, 13) outside the both ends of the core 8. This casing 9 is comprised by a channel-state material 9*a* and a lid material 9*b* in this embodiment as shown in FIGS. 1 and 8. The plate thickness of the channel-state body material 9*a* and the lid material 9*b* is formed sufficiently larger than that of the core body 5 as shown in FIG. 9. This increases the strength of the casing 9, facilitates forming of the core body 5 bent in the complicated state, and improves machining accuracy of a fitting edge portion 15 with the U-shaped section provided at its both ends as well as brazing accuracy of the joint between the casing 9 and the core body 5.

Figure 11:
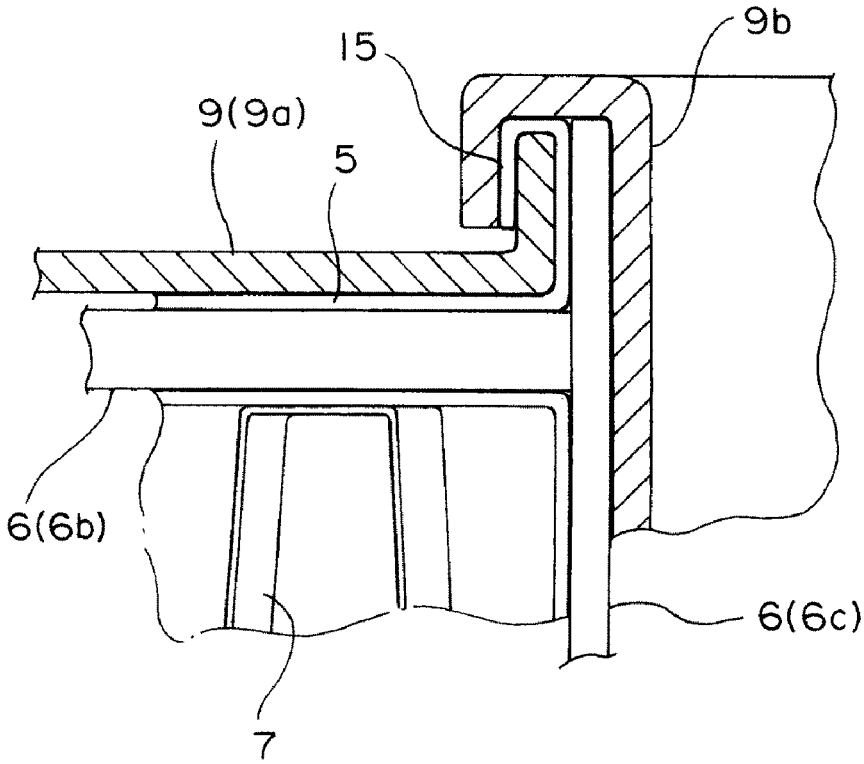
FIG. 11 is a cross sectional view of an essential part illustrating still another example of FIG. 9.

The channel-state material 9*a* has its inner circumferential face in contact with both the upper and lower faces and one side of the core body 5 so as to block between the adjacent turned-up end edges 1 of the core body 5. The lid material 9*b* blocks the opening side of the channel-state material 9*a*, blocks the other side of the core body 5 and in the longitudinal direction. The L-shaped portions of the upper and lower both ends of the lid material 9*b* are fitted with the outer face side of the fitting edge potion 15. FIG. 11 illustrates a state where the sections of the ends are stood in the L-shape and wound/tightened. In this case, the tip end of the lid material 9*b* is made into the shape conforming to that.

Figure 13:
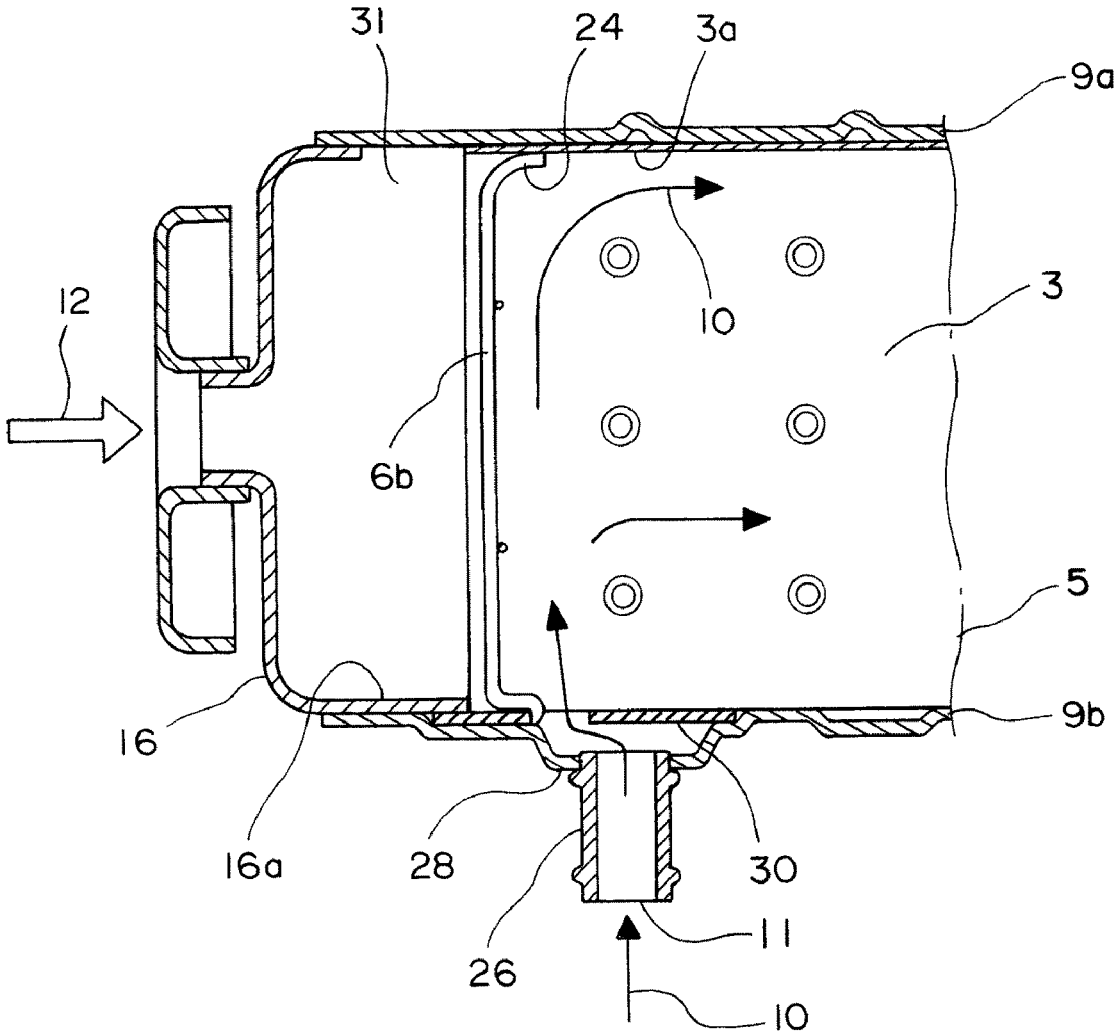
FIG. 13 is a plan view of a longitudinal section of the heat exchanger.

Next, opening ends of the header portions 31 of the both ends of the casing 9 in the longitudinal direction are blocked by header end lids 16, 17 made of a pair of high heat-resistant/corrosion-resistant materials, and a flange 25 is fitted to the outside thereof. The header end lids 16, 17 are swollen outward in the pot shape in this embodiment, and a port for the second fluid 12 is opened at the center. Moreover, on one side of each of the header end lids 16, 17, extension portions 16*a*, 17*a* are integrally extended and the extension portions 16*a*, 17*a* cover the inner surfaces of the both ends of the lid material 9*b* as shown in FIG. 13.

Brazing material is overlaid or arranged between connected portion of such heat exchanger as described above, and the whole in the assembled state shown in FIG. 2 is integrally brazed/fixed in a high-temperature furnace.

Figure 7:
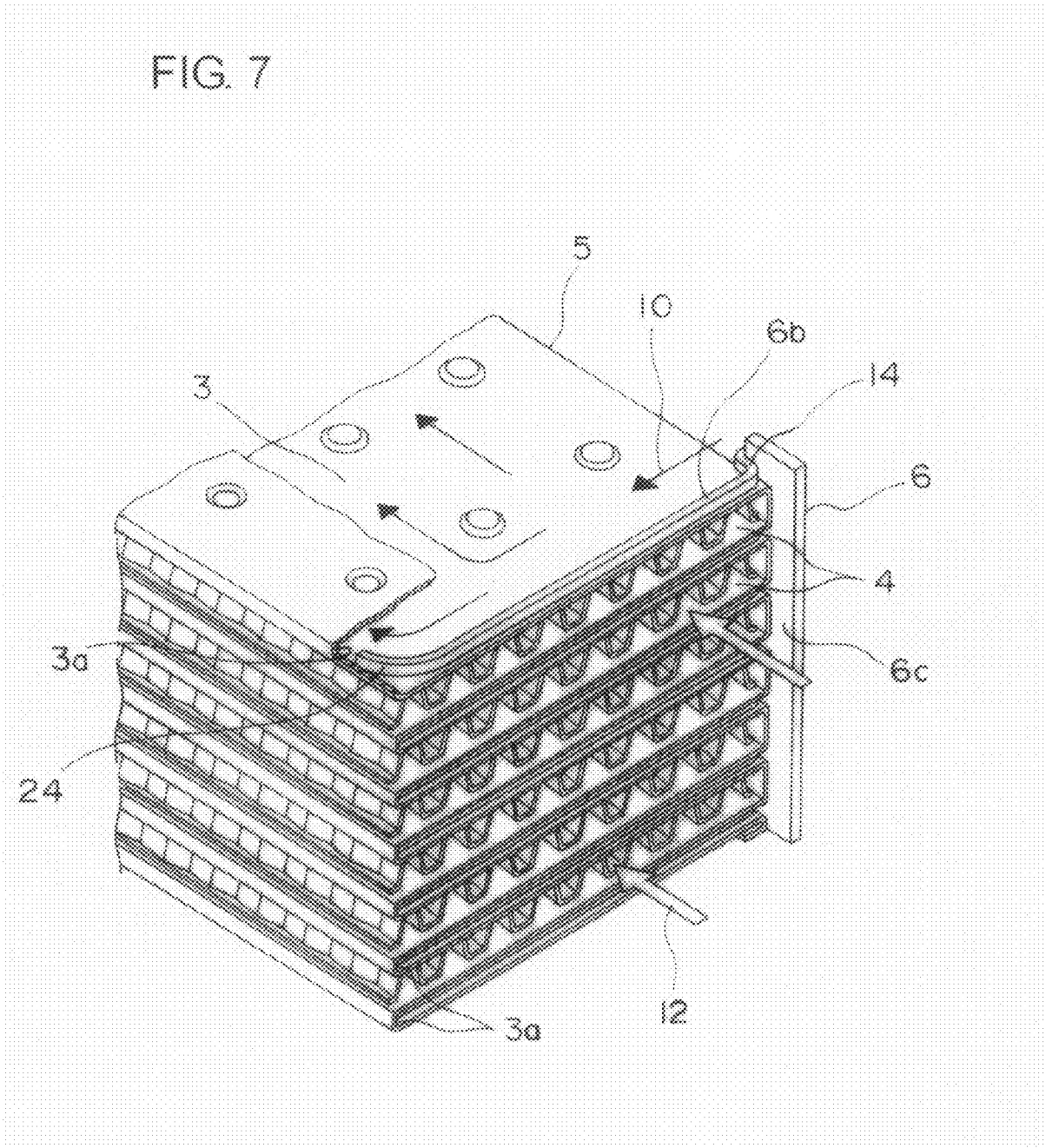
FIG. 7 is an explanatory view illustrating another example of comb-teeth 6*b* of the comb-state member 6.

And as shown in FIG. 7, the first fluid 10 is supplied to the first flow passage 3 side, while the second fluid 12 is supplied to the second flow passage 4 side. As an example, the first fluid 10 made of cooling water is supplied to each of the first flow passages 3 through one of the pipes 26 and the small tank portions 28 projected on one side of the casing 9 and it communicates in the longitudinal direction and flows out of the other pipe 26. Also, as an example, the second fluid 12 made of a high-temperature exhaust gas is supplied to each of the second flow passages 4 through the opening of the header end lid 16 and an opening 13 of the casing 9.

The pair of comb-state members 6 (FIG. 1) constitutes the header plates.

This comb-state member 6 can have its tip end portion formed in a curved portion 24 as shown in FIG. 7, and in this case, the flow of the first fluid 10 can be smoothly guided in the longitudinal direction at the end of the comb-state member 6. By this, retention portion of the first fluid 10 can be eliminated, and if the first fluid 10 is cooling water, boiling at that part can be prevented, and heat exchange can be promoted.

Figure 12:
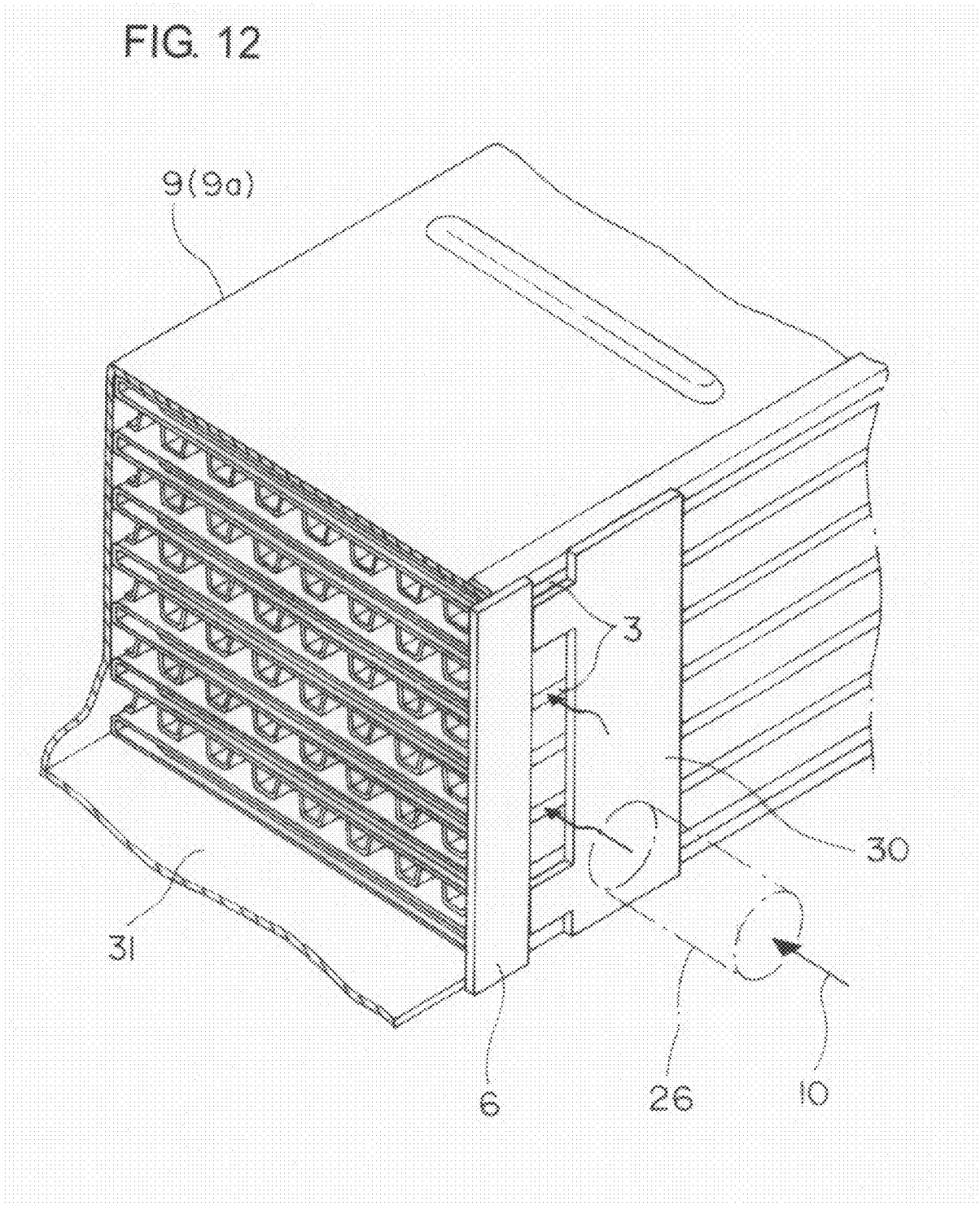
FIG. 12 is a perspective explanatory view illustrating a buffer plate of the heat exchanger of the present invention.

Next, FIGS. 12, 13 illustrate a state where a buffer plate 30 is provided at the inlet side of the first fluid 10 so as to enable even communication of the cooling water in each part of the first flow passages 3. In the embodiment of FIG. 2, since the pair of small tank portions 28 exist at the both ends of the lid material 9*b*, the first fluid 10 flowing from the pipe 26 tends to flow more on the lid material 9*b* side when communicating through each part of the first flow passages 3. Then, the buffer plate 30 is opposed to the opposite face on the outlet side of the cooling water of the pipe 26, and an opening is formed in the slit state only on the left side, in FIG. 13, so that the flow velocity of the first fluid 10 flowing out of the opening is increased. The first fluid 10 is guided by the motion energy to a position separate from the lid material 9*b*. That is, the first fluid 10 bypasses the buffer plate 30 and flows out to the first flow passage 3 in the narrowed state as shown by an arrow.

The invention claimed is:

1. A heat exchanger comprising a core body in which a strip-shaped metal plate is turned up and bent in a fanfold manner with turned-up end edges alternately formed at one end and the other end of a rectangular flat face portion and flat first flow passages and second flow passages are provided alternately in the thickness direction of the metal plate, each of the first flow passages of the core body being blocked by each comb tooth of a pair of comb-state members at both end positions of said turned-up end edge, and a fin being set within said second flow passages so as to constitute a core, the outer periphery of the core body being fitted with a cylindrical casing so as to block the adjacent turned-up end edges, a first fluid being guided to each of the first flow passages by a pair of ports on the outer face of said casing, while a second fluid being guided from one of cylindrical openings of said casing to the other opening through each of the second flow passages, wherein said casing comprises a channel-state material covering three faces of the outer periphery of said core body and a lid material blocking the opening of the channel-state material, said channel-state material being formed of a high heat-resistant and corrosion-resistant material, said lid material being formed of a material having lower heat-resistance and corrosion-resistance than the channel-state material;

the casing having a pair of longitudinal ends and header portions extending outward from each of the ends of the casing, the longitudinal ends each being provided with a header end lid that blocks its end of the casing, each header end lid being formed of a high heat-resistant and corrosion-resistant material;

each header end lid having an extension portion covering an inner surface of each header portion;

in said core body, a starting end and a terminating end of the turning-up of said strip-shaped metal plate are both located at said turned-up end edge on one side;

a fitting edge portion with a section turned up in the U-shape conforming to the plate thickness of said channel-state material is provided at the starting end and the terminating end; and the end edge of said opening of the channel-state material is fitted with the fitting edge portion and the both are brazed and fixed.

* * * * *